United States Patent [19]

Arai

[11] Patent Number: 4,830,255

[45] Date of Patent: May 16, 1989

[54] FASTENER CONVEYING APPARATUS FOR FASTENER ASSEMBLING MACHINE

[75] Inventor: Takeshi Arai, Toyama, Japan

[73] Assignee: Yoshida Kogyo K. K., Tokyo, Japan

[21] Appl. No.: 97,829

[22] Filed: Sep. 17, 1987

[30] Foreign Application Priority Data

Sep. 18, 1986 [JP] Japan ..... 61-143420[U]

[51] Int. Cl.[4] ..... A41H 37/04

[52] U.S. Cl. ..... 227/116; 112/113; 227/139

[58] Field of Search ..... 227/18, 36, 37, 39, 227/41, 48, 114–116, 139, 128, 120, 123; 112/113, 110; 221/285

[56] References Cited

U.S. PATENT DOCUMENTS

| | | | |
|---|---|---|---|
| 2,966,681 | 1/1961 | Campbell | 227/139 |
| 3,253,760 | 5/1966 | Doyle et al. | 227/120 |
| 3,420,427 | 1/1969 | Schmidt | 227/116 |
| 4,549,681 | 10/1985 | Yamamoto et al. | 227/123 X |
| 4,624,199 | 11/1986 | Yoshieda | 112/113 |
| 4,628,842 | 12/1986 | Taga | 112/113 |

FOREIGN PATENT DOCUMENTS 59-11681 3/1984 Japan .

*Primary Examiner*—Frank T. Yost
*Assistant Examiner*—James L. Wolfe
*Attorney, Agent, or Firm*—Hill, Van Santen, Steadman & Simpson

[57] ABSTRACT

A fastener conveying apparatus, for a fastener assembling machine, comprises a chute defining a first passageway for guiding therethrough fastener members in succession, a guide pivotally mounted on a fixed guide holder and defining a second passageway for guiding therethrough one fastener member at a time as it is pushed by a pusher. The guide is pivotally movable downwardly away from the chute.

6 Claims, 2 Drawing Sheets

FASTENER CONVEYING APPARATUS FOR FASTENER ASSEMBLING MACHINE

BACKGROUND OF THE INVENTION

1. Field of the Invention

The present invention relates to a machine for assembling a pair of fastener members of a garment fastener, such as a snap fastener, a hook-and-eye fastener, and a button, with a garment fabric disposed between the two fastener members. More particularly, the invention relates to an apparatus for conveying the fastener members to the fastener assembling machine.

2. Description of the Prior Art

In a fastener-assembling machine, a member of successive pairs of fastener members of garment fasteners are supported on upper and lower units, respectively, of a punch assembly; a punch of the upper unit is moved toward a die of the lower unit to join the two fastener members together. Conventionally, the two kinds of fasteners are respectively supplied to the punch assembly by two separate conveying apparatuses. The conventional conveying apparatus for the fastener members of each kind includes a chute defining a first passageway through which the fastener members slide downwardly in succession, and a guide defining a second passageway into which the fastener members are to be received one at a time from the first passageway and into which a reciprocating pusher is inserted to push the individual fastener member toward the punch assembly. Since the chute is connected to the guide in such a manner that the first passageway lies perpendicularly to the second passageway as viewed in plan, the direction of conveying the fastener member is converted by an angle of 90° as it passes the junction of the first and second passageways. A problem with this prior arrangement is that the fastener members tend to be jammed at the junction of the first and second passageways. Further, for removing such jammed fastener members, it is hitherto customary to pivotally move a guide plate of the guide horizontally outwardly by hand to thereby make the second passageway open or exposed, which is laborious and time-consuming. This prior art is exemplified by Japanese Patent Publication No. 59-11681.

SUMMARY OF THE INVENTION

It is therefore an object of the present invention to provide a fastener conveying apparatus, for a fastener assembling machine, in which apparatus jamming of fastener elements scarcely occur and, even if jamming occured, the jammed fastener member can be removed easily.

According to the present invention, a fastener conveying apparatus, for a fastener assembling machine, comprises a guide holder fixed to a frame, a chute fixed to the frame and defining a first passageway, and a guide pivotally mounted on the guide holder and defining a second passageway into which a reciprocating pusher is inserted. The guide is pivotally movable downwardly away from a lower end of the chute to release a fastener member jammed at the junction of the first and second passageways.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
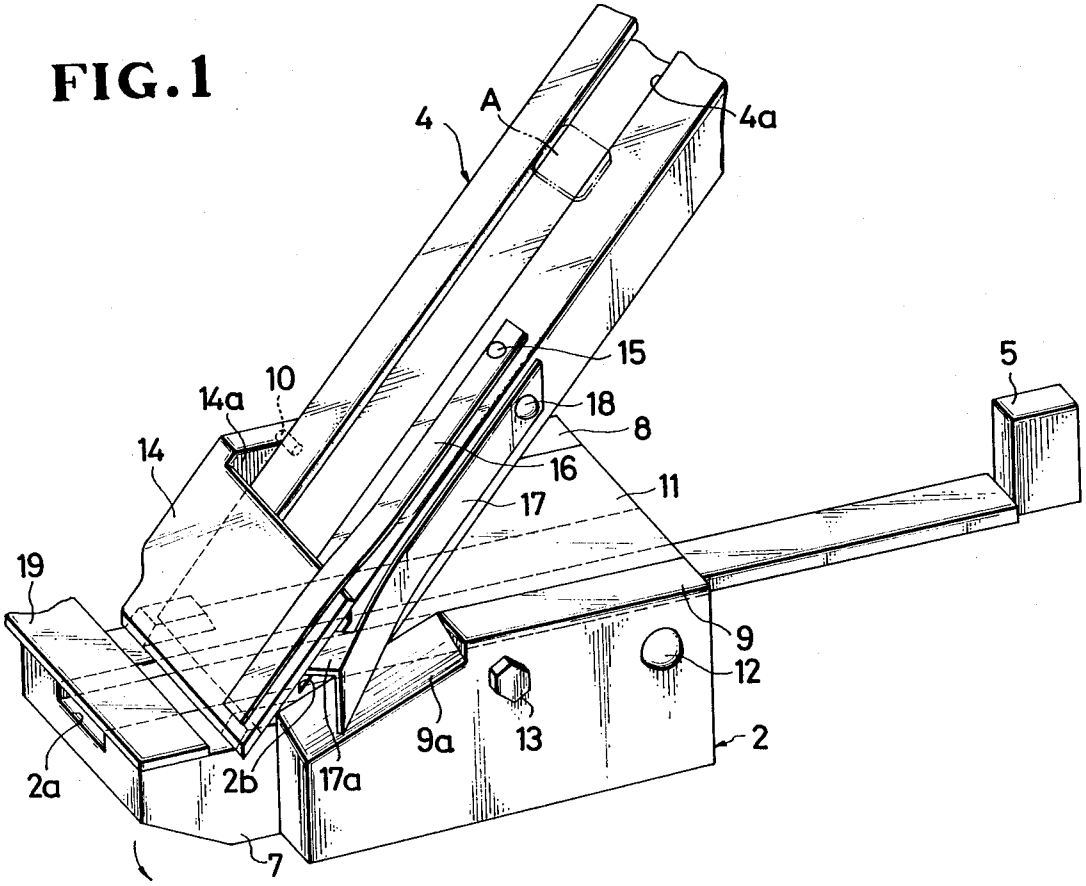
FIG. 1 is a fragmentary perspective view of a fastener conveying apparatus embodying the present invention.
Figure 2:
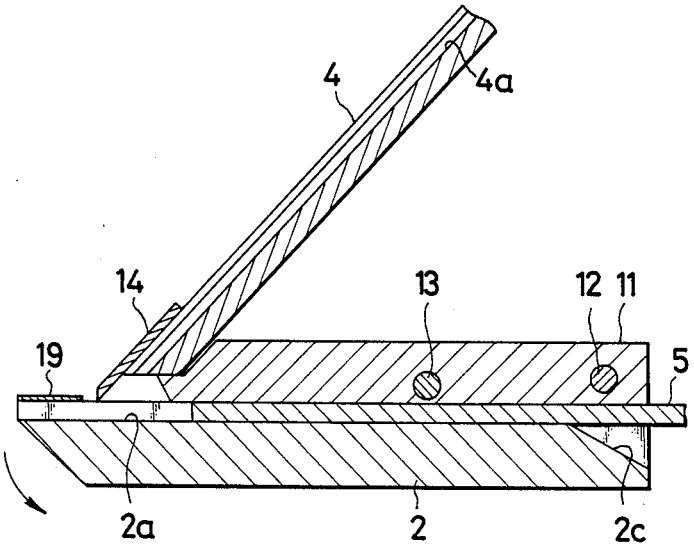
FIG. 2 is a vertical cross-sectional view of the apparatus.

FIGS. 1 and 2 show an apparatus for conveying fastener members A one at a time to a punch assembly (not shown) of a fastener assembling machine for joining the fastener member A with a companion fastener member (not shown), with a garment fabric (not shown) disposed between the two fastener members.

The apparatus generally comprises a guide holder 11 fixed to a frame (not shown), a sloping chute 4 fixed to the frame for conveying a succession of fastener members A downwardly from a non-illustrated hopper, and a horizontal guide 2 supported by the guide holder 11 for conveying the fastener members A one at a time from the chute 4 toward the non-illustrated punch assembly of the fastener assembling machine.

The chute 4 has a generally C-shaped cross section defining an inclined first passageway 4*a* through which a succession of fastener members A is slidably received.

The guide 2 includes a guide body 7 having a generally C-shaped cross section defining a normally horizontal second passageway 2*a* in which a reciprocating elongated pusher 5 is slidably received. As the pusher 5 reciprocates in the second passageway 2*a*, the fastener elements A are received one at a time from the first passageway 4*a* into the second passageway 2*a* and then guided through the second passageway 2*a*.

The guide body 7 has a pair of upwardly directed side flanges 8, 9 integral with the guide body 7 and pivotally supported on the guide holder 11 by a first pivot 12 remote from a lower end of the chute 4. Thus the guide 2 is pivotally movable about the firs pivot 12. The pivotal movement of the guide 2 is normally prevented by a stop screw 13 that releasably extends through the pair of side flanges 8, 9 and the guide holder 11 at a position between the first pivot 12 and the lower end of the chute 4. The guide 2 has at a rear end portion of the guide body 7 an inclined surface 2*c* sloping rearwardly. The inclined surface 2*c* (FIG. 2) serves not only to allow downward or counterclockwise movement of the guide 2, but also to restrict such downward or counterclockwise pivotal movement of the guide 2.

As the stop screw 13 is removed, the guide 2 is pivotally moved downwardly or counterclockwise (FIG. 2) about first pivot 12 by gravity in such a manner that the second passageway 2*a* is separated away from the first passageway 4*a*. As a result, a jammed fastener member A, if any at the junction between the first and second passageways 4*a*, 2*a*, is allowed to fall.

As shown in FIG. 1, one of the side flanges 9 of the guide body 7 has at its front upper edge a cam surface 9*a* sloping forwardly and outwardly. A first leaf spring 17 is secured at one (upper) end to an outer surface of the chute 4 by a pin 18 and has at the other (lower) end to an inwardly directed projection 17*a* projectable into the first passageway 4*a* through a side slit 2*b* for preventing the subsequent fastener elements A in the first passageway 4*a*. While the guide 2 is in a horizontal posture (FIG. 1), the lower end of the first leaf spring 17 is in engagement with the cam surface 9*a* in such a manner that the projection 17*a* is retracted from the first passageway 4*a* against the bias of the first leaf spring 17. As the guide 2 is pivotally moved substantially downwardly, the lower end of the first leaf spring 17 is disengaged from the cam surface 9*a*, thus causing the projection 17*a* to project into the first passageway 4*a* under the bias of the first leaf spring 17.

A chute cover 14 is pivotally mounted on the chute 4 by a second pivot 10, covering the lower end portion of the first passageway 4*a* and extending beyond the distal end thereof. The chute cover 14 is normally urged against the upper surface of the chute 4 by a second leaf spring 16 secured at one end to an upper surface of the chute 4 by a pin 15. As a fastener member A arrives at the junction between the first and second passageways 4*a*, 2*a*, the chute cover 14 is pivotally moved slightly away from the upper surface of the chute 4 against the bias of the second leaf spring 16. This chute cover 14 with the second leaf spring 16 serves to assist in preventing the fastener members A from jamming at the junction between the first and second passageways 4*a*, 2*a*. The cover 14 is of a generally L-shaped cross section having a flange 14*a* through which the second pivot 10 extends into the chute 4.

The front end portion of the second passageway 2*a* of the guide 2 is covered by an auxiliary cover 19, while the majority of the remaining portion of the second passageway 2*a* is covered by the guide holder 11.

The first passageway 4*a* extends in the same direction as the second passageway 2*a*, as viewed in plan, so that a fastener member A discharged from the chute 4 is conveyed to the punch assembly through the guide 2 by the pusher 5 without the need of correcting the orientation of the fastener member A.

If jamming of a fastener member A at the junction between the first and second passageways 4*a*, 2*a* happened to occur, such a jammed fastener element A can be removed in the following manner.

Firstly the stop screw 13 is removed so as to allow the guide 2 to pivotally move counterclockwise (FIG. 2) about the pivot 12 downwardly away from the lower end of the chute 4. This releases the jammed fastener member A to fall. Yet, if the jammed fastener member A cannot be released, the chute cover 14 is pivotally moved by hand upwardly about the pivot 10.

Although various minor modifications may be suggested by those versed in the art, it should be understood that I wish to embody within the scope of the patent warranged hereon, all such embodiments as reasonably and properly come within the scope of my contribution to the art.

What is claimed is:

1. A fastener conveying apparatus for a fastener assembling machine, comprising:

(a) a stationary chute defining a first passageway for guiding therethrough a plurality of fastener members in succession;

(b) a guide holder fixed relative to said chute;

(c) a guide having a pair of side flanges pivotally mounted on said guide holder by a first pivot extending through said side flanges and said slide holder remote from a lower end portion of said chute and defining a second passageway communicatable with said first passage way for receiving from said first passageway the fastener members one at a time and for guiding the individual fastener member through said second passageway, said guide being pivotally movable substantially vertically away from said lower end of said chute;

(d) a pusher reciprocable in said second passageway for pushing the individual fastener member out of said second passageway;

(e) means for releasably holding said guide in a horizontal posture; and (f) a first leaf spring secured at its upper end to an outer surface of said chute and having at its lower end an inwardly directed projection normally urged to project through a side slot in said chute into said first passageway under the bias of said first leaf spring, one of said side flanges of said guide having at its front upper edge a cam surface sloping forwardly and outwardly, said cam surface being engageable with said lower end of said first leaf spring so as to prevent the latter from projecting into said first passageway as said guide is in said horizontal posture.

2. A fastener conveying apparatus according to claim 1, further including a chute cover pivotally mounted on said chute by a second pivot and covering the lower end portion of said first passageway and extending beyond a distal end thereof.

3. A fastener conveying apparatus according to claim 2, wherein said chute cover is normally urged against an upper surface of said chute by a second leaf spring.

4. A fastener conveying apparatus according to claim wherein said chute cover has a flange through which said second pivot extends into said chute.

5. A fastener conveying apparatus according to claim 1, wherein said holding means includes a stop screw for removably extending through said side flanges and said guide holder at a position between said first pivot and said lower end portion of said chute.

6. A fastener conveying apparatus according to claim 5, wherein said guide has at its rear end and inclined surface sloping rearwardly.

* * * * *